United States Patent [19]

Nakashima et al.

[11] Patent Number: 4,836,429

[45] Date of Patent: Jun. 6, 1989

[54] METHOD AND APPARATUS OF NON-CONTACT CONVEYANCE OF A WEB

[75] Inventors: Hiroshi Nakashima; Masayuki Kawarada; Sanshirou Fukuhara, all of Kanagawa, Japan

[73] Assignee: Fuji Photo Film Co., Ltd., Kanagawa, Japan

[21] Appl. No.: 74,817

[22] Filed: Jul. 17, 1987

[30] Foreign Application Priority Data

Jul. 17, 1986 [JP] Japan ..... 61-166793

[51] Int. Cl.[4] ..... B65H 20/14

[52] U.S. Cl. ..... 226/7; 226/97

[58] Field of Search ..... 226/197, 97.7; 34/156, 34/160

[56] References Cited

U.S. PATENT DOCUMENTS

| | | | |
|---|---|---|---|
| 3,448,907 | 6/1969 | Otepka et al. | 226/97 |
| 3,837,551 | 9/1974 | Schregenberger | 226/97 |
| 4,058,244 | 11/1977 | Vits | 226/97 |
| 4,218,001 | 8/1980 | Vits | 226/97 |
| 4,384,666 | 5/1983 | Kaponen et al. | 226/97 |

FOREIGN PATENT DOCUMENTS

| | | |
|---|---|---|
| 2615258 | 10/1977 | Fed. Rep. of Germany . |
| 2941325 | 4/1980 | Fed. Rep. of Germany . |
| 0637089 | 7/1983 | Switzerland . |
| 0996290 | 6/1965 | United Kingdom . |
| 2013600 | 7/1982 | United Kingdom . |

*Primary Examiner*—Stuart S. Levy
*Assistant Examiner*—Lynn M. Sohacki
*Attorney, Agent, or Firm*—Sughrue, Mion, Zinn, Macpeak & Seas

[57] ABSTRACT

A web conveying apparatus comprising a series of air jetting boxes alternately arranged on opposite sides of a conveyed web. Each air jetting box has two outlets jetting air toward the web. The outlets are at opposite edges of the air jetting box and direct the air inwardly at an angle of 15° to 45° from the perpendicular of the main or air jetting surface of the box.

5 Claims, 2 Drawing Sheets

METHOD AND APPARATUS OF NON-CONTACT CONVEYANCE OF A WEB

BACKGROUND OF THE INVENTION

1. Field of the Invention

This invention relates to a method of non-contact conveyance of a long belt-shaped support of plastic film, paper or the like (hereinafter referred to as "a web"). More particularly the invention relates to a method of conveying a web in a non-contact manner in the manufacture of a photographic photo-sensitive material such as a photographic film or print paper, a photomechanical material, a magnetic recording material such as a magnetic recording tape, or a recording material such as a pressure-sensitive sheet or heat-sensitive copying sheet.

2. Background of the Invention

Heretofore, a roller system has been extensively employed to convey a web of plastic film or paper. However, since in the roller system the web is conveyed while being in contact with the rollers, depending on the operating conditions, the web may be scratched or creased, i.e., the product may be damaged. Especially in the case of a web having coated films on both its sides, its quality is lowered when conveyed by the roller system. In order to overcome these difficulties, a method has been employed in which a jetted air stream is applied to a web so that the web is conveyed while being floated, i.e., it is conveyed in a non-contact manner.

FIG. 1 is a sectional side view showing a conventional method of conveying a web in a non-contact manner.

In the conventional method most extensively employed, as shown in FIG. 1, static pressure support type air jetting boxes 3 are arranged alternately on both sides of a web 1. Air streams are jetted through surfaces 5 of the air jetting boxes which are confronted with the web in such a manner that the jetted air streams are perpendicular to the web 1, thus floating the web in the form of a belt which is wavy in the direction of transport. In the method, in order to convey a web stably, it is essential to carefully design the configuration and dimension of the air jetting boxes 3 and the arrangement or position of air jetting outlets 4. Some of these conditions have been disclosed by Japanese Patent Application (OPI) No. 72847/1979. That is, the air jetting outlets 4 formed along two edges of each air jetting box 3 are slits through which air streams are jetted perpendicular to the air jetting surface. The transport of the web 1 is stabilized when $W \geqq P/6$ is satisfied. In this expression, W is the distance between front and rear air jetting outlets 4*a* and 4*b*, and P is the distance between two adjacent corresponding positions where the pressures of the air streams act on the web 1 (that is, P is the pitch between two adjacent air jetting boxes on the same side of the web 1). In addition, it has been also disclosed that W should be relatively small (preferably not more than 1/5 of the width of the web). In conclusion, the condition for conveying a web stably is that the distance P is small.

As is apparent from the above description, in the conventional web conveying apparatus it is necessary to provide a number of air jetting boxes and accordingly to jet a large quantity of air. As a result, the equipment cost and the running cost are correspondingly increased.

SUMMARY OF THE INVENTION

Accordingly, an object of this invention is to eliminate the above-described difficulties accompanying a conventional web conveying method.

More specifically, an object of the invention is to provide a method of conveying a web in a non-contact manner in which a web can be stably conveyed with a small quantity of jetted air and in which the equipment cost and running cost can be reduced.

The inventors have conducted intensive research on these problems and accomplished the present invention.

The foregoing objects of this invention have been achieved by a method of conveying a web in a non-contact manner in which static pressure support type air jetting boxes are arranged alternately on both sides of the web in the direction of conveyance of the web to convey the web in the form of a belt which is wavy in the direction of conveyance. According to the invention, each of two air jetting outlets formed respectively along two edges of each of the air jetting boxes has an air jetting direction which is inclined by 15° to 45° inwardly of the air jetting box from the plane perpendicular to the air jetting surface of the air jetting box.

The distance between the air jetting outlets of each air jetting box is at least 20 cm and is 30% to 80% of the width of the web.

DETAILED DESCRIPTION OF THE PREFERRED EMBODIMENTS

Figure 1:
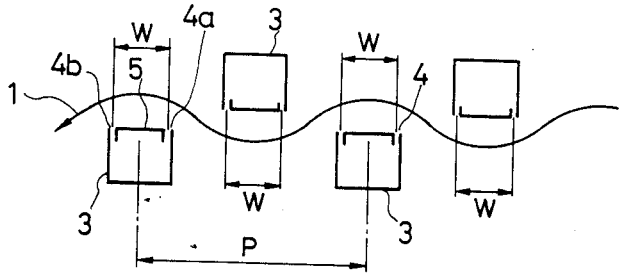
FIG. 1 PRIOR ART
FIG. 1 is a sectional side view for a description of one example of a conventional method of conveying a web in a non-contact manner in which conventional static pressure support type air jetting boxes are employed.
Figure 2:
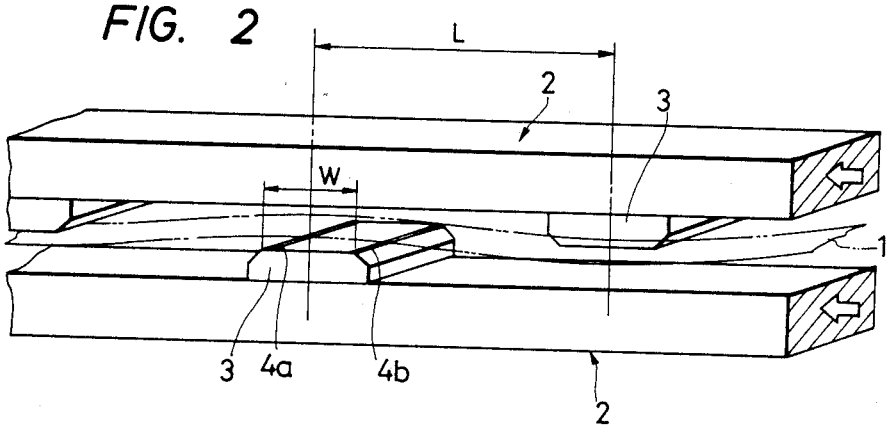
FIG. 2 is a perspective view for a description of one example of a method of conveying a web in a non-contact manner according to this invention.
Figure 3:
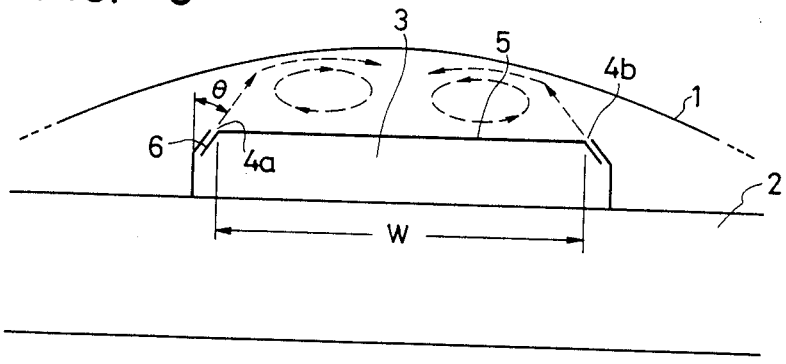
FIG. 3 is an enlarged cross-sectional view showing a static pressure support type air jetting box employed in the method of the invention.

FIG. 2 is a perspective view showing one example of the method of conveying a web in a non-contact manner according to the invention. FIG. 3 is an enlarged cross-sectional view of an air jetting box 3 employed in the method of the invention. In FIG. 2, jetted air streams are supplied from air pumps to air jetting boxes 3 through ducts 2 running in the direction of movement of a web 1. As the air streams are supplied in the direction of movement of the web 1 as was described above, the internal pressure distribution of the ducts 2 in the widthwise direction of the web 1 is made uniform and the amount of flotation of the web 1 in the widthwise direction becomes constant so that the web 1 can be stably conveyed.

In the method of the invention, the distance L between adjacent air jetting boxes can be increased corresponding to an increase in the distance W between the air jetting outlets 4a and 4b provided along two edges of each air jetting box 3.

The air jetting boxes in the invention is of the static pressure support type. As shown in FIG. 3, each of the air jetting boxes 3 has the air jetting outlets 4a and 4b formed along the front and rear edges of its surface 5 confronting the web 1 so that the air streams jetted through the air jetting outlets provide static pressure in the space between the web 1 and the air jetting box surface 5 to thereby support the web 1.

In the invention, the air jetting outlets 4a and 4b along two edges of each air jetting box need slit guides 6 to direct the jetted air streams. The outlets are preferably in the form of a slit. However, each air jetting outlet may be formed by arranging a number of holes in a line. Furthermore, in each of the air jetting boxes, additional air jetting outlets may be formed between the air jetting outlets provided along the front and rear edges. In the invention, it is essential that the direction of air streams jetted through the air jetting outlets at both edges of each air jetting box is inclined 15° to 45° inwardly of the air jetting surface 5, that is, toward each other, instead of forming right angles with the air jetting surface 5. This permits increasing the distance W between the air jetting outlets 4a and 4b provided along the two edges of the air jetting box 3.

However, if the distance W is excessively large, then it becomes difficult to maintain the static pressure between the air jetting surface of the air jetting box 3 and the web 1. Therefore, it is desirable that the distance W is 20 cm or more and 30% to 80% of the web width.

As was described above, the air jetting direction of each of the air jetting outlets 4a and 4b at both edges of each static pressure support type air jetting box 3 is inclined by 15° to 45° inwardly of the air jetting box 3 from the plane perpendicular to the air jetting surface 5 of the box 3. Therefore, the static pressure in the space between the central portion of the air jetting surface 5 and the web 1 is held more stably than that in the case where the air jetting angle is 90°. This permits the distance between the air jetting outlets 4a and 4b formed along the front and rear edges of each air jetting box 3 to be at least 20 cm and 30% to 80% of the web width. As a result, the air jetting boxes can be arranged at intervals larger than those in the conventional method.

The air jetting box 3 having a large width W according to the invention is substantially equal in the quantity of air jetted to the conventional air jetting box having a small width W. Because of the increased width W, the wavy, stable conveyance of the web can be maintained and the distance L between the adjacent air jetting boxes can be increased. This means that, where the length of conveyance is constant, the number of air jetting boxes to be used can be decreased. Accordingly, the quantity of air jetted for floating the web can be small, when compared with the case of the conventional method. In practice, the intervals of arrangement of the air jetting boxes can be determined according to the material, conveyance condition and object of use of the web. For instance, in the case where the web has a high rigidity, the repetition interval of the air jetting boxes should be made large. In this case, although the quantity of air jetted is greatly decreased, the web can be stably conveyed. In the case where the web has a low rigidity, the width W should be decreased. In this case, while the web can be stably floated, the quantity of air jetted can be decreased.

SPECIFIC EXAMPLE

The non-contact type web conveying apparatus shown in FIG. 2 was used to provide a transport test for a web of PET 1000 mm in width and 100 μm in thickness under the air jetting conditions of $\theta=45°$ and W=600 mm.

The quantity of air jetted was measured under the stable transport condition that the web would not flutter, be creased, be contacted, nor be shifted. It was found that the quantity of air jetted in the method of the invention was $\frac{1}{3}$ to $\frac{1}{4}$ of that in the conventional method (as disclosed by Japanese Patent Application (OPI) No. 72847/1979). In addition, the equipment cost of the apparatus of the invention was $\frac{1}{2}$ to $\frac{1}{3}$ of that of the conventional apparatus (according to Japanese Patent Application (OPI) No. 72847/1979).

As is apparent from the above description, because the air jetting direction of each of the air jetting outlets formed along the two edges of each air jetting box is inclined by 15° to 45° inwardly of the air jetting surface from the plane perpendicular to the air jetting surface, the distance between the air jetting outlets can be made large and the pressure of gas for floating the web can be reduced when compared with those in the conventional method. Accordingly, the web is substantially prevented from fluttering and creasing. That is, the web can be stably conveyed.

In addition, for the same reason, the intervals of arrangement of the air jetting outlets can be increased, with the result that the number of air jetting boxes can be decreased. Accordingly, the quantity of air jetted (or energy cost) and the equipment cost can be greatly reduced.

Figure 4:
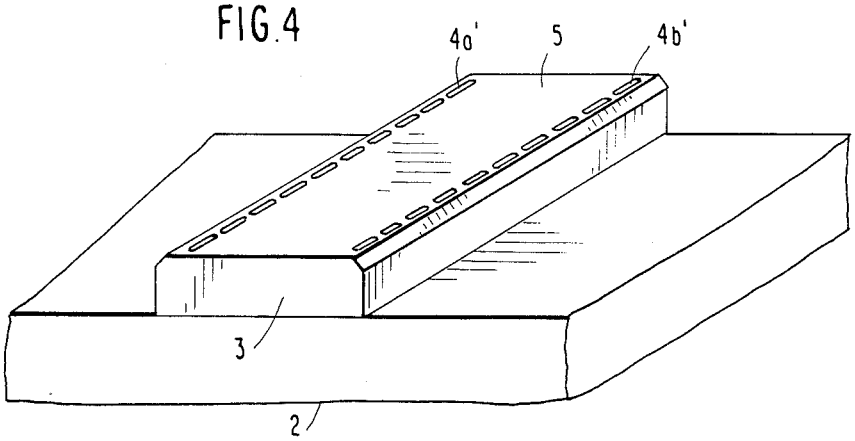
FIG. 4 is a perspective plan view of a second embodiment of structure for an air jetting box according to the present invention.
Figure 5:
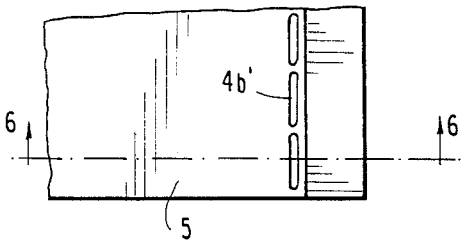
FIG. 5 is a more detailed view showing the slit structure of the air jetting box of FIG. 4.
Figure 6:
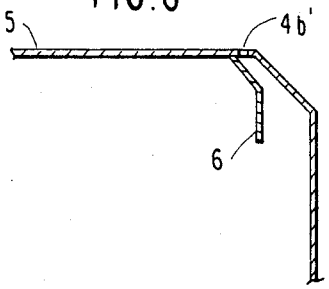
FIG. 6 is a side view similar to FIG. 3 and showing formation of the slit structure of the second embodiment.

For example, FIG. 4 shows an embodiment of an air jetting box in which channel slits 4a, 4b are interrupted to form a series of apertures 4a', 4b'. This effectively places a number of holes in a line in each air jetting outlet, as was mentioned above. FIG. 5 shows a relationship between the apertures 4b' and the air jetting surface 5. FIG. 6 shows how a web would lie over an air jetting box having such apertures 4b'.

What is claimed is:

1. A method of conveying a web, comprising the steps of:

arranging a plurality of air boxes on alternate sides of a path;

separating two edges of each box by at least 20 cm and by 30% to 80% of a width of said web;

conveying a web along said path; and jetting air from said two edges of each of said air boxes toward said conveyed web, said air being jetted from said two edges being inclined toward each other at angles between 15° to 45° from the perpendicular of the air jetting surface of said air box.

2. A web conveying apparatus, comprising: a plurality of air boxes, alternately arranged on opposite principal sides of a web which is conveyed in a first direction, each of said air boxes having two outlets formed on edges of an enclosed box opposed along a first direction in which a web is conveyed and facing said conveyed web, said two outlets having outlet directions inclined toward each other in a direction of said web at an angle of 15° to 45° from the perpendicular of a plane connecting said two edges, wherein said two edges of each air box are separated by at least 20 cm, and said two edges of each air box are separated by 30% to 80% of a width of said conveyed web.

3. A web conveying apparatus as recited in claim 2, wherein said air jetting box further comprises a planar surface facing said web and connecting said two edges.

4. A web conveying apparatus as recited in claim 2, wherein said outlets are channel slits extending perpendicularly to said first direction along said planar surface.

5. A web conveying apparatus as recited in claim 2, wherein each of said outlets is a series of apertures arranged perpendicularly to said first direction along said planar surface.

* * * * *